United States Patent [19]

Scholz et al.

[11] Patent Number: 4,465,927

[45] Date of Patent: Aug. 14, 1984

[54] PHOTOSENSITIVE TUBE WITH LIGHT BIAS

[75] Inventors: Hans Scholz, Maldon; Paul C. Bailey, Chelmsford, both of England

[73] Assignee: English Electric Valve Company Limited, Essex, England

[21] Appl. No.: 347,044

[22] Filed: Feb. 8, 1982

[30] Foreign Application Priority Data

Feb. 12, 1981 [GB] United Kingdom ..... 8104346

[51] Int. Cl.[3] ..... H01J 31/50

[52] U.S. Cl. ..... 250/213 VT; 313/523

[58] Field of Search ..... 250/213 VT; 313/523, 313/524

[56] References Cited

U.S. PATENT DOCUMENTS 3,784,831 1/1974 Reif ..... 250/213 VT 3,881,104 4/1975 Donjon et al. ..... 250/213 VT

*Primary Examiner*—David C. Nelms

*Attorney, Agent, or Firm*—Kenyon & Kenyon

[57] ABSTRACT

A photosensitive tube of the kind having a photoconductive target formed of a material such as lead monoxide exhibits an effect generally termed lag when the tube operates at very low light levels. Lag is undesirable and can be minimized by providing a low light level bias which illuminates the rear of the target. The present invention provides light bias in the form of small light emitting diodes which are placed externally of the evacuated envelope of the tube in localized recesses adjacent to a tubular anode electrode at a point where the anode diameter changes. In this way the light emitting diodes can be accommodated within the normal overall envelope of the tube and in a manner which conveniently permits an even diffused illumination of the target. This arrangement is particularly applicable to small diameter tubes to which conventional light bias cannot readily be applied.

12 Claims, 2 Drawing Figures

PHOTOSENSITIVE TUBE WITH LIGHT BIAS

Figure 1:
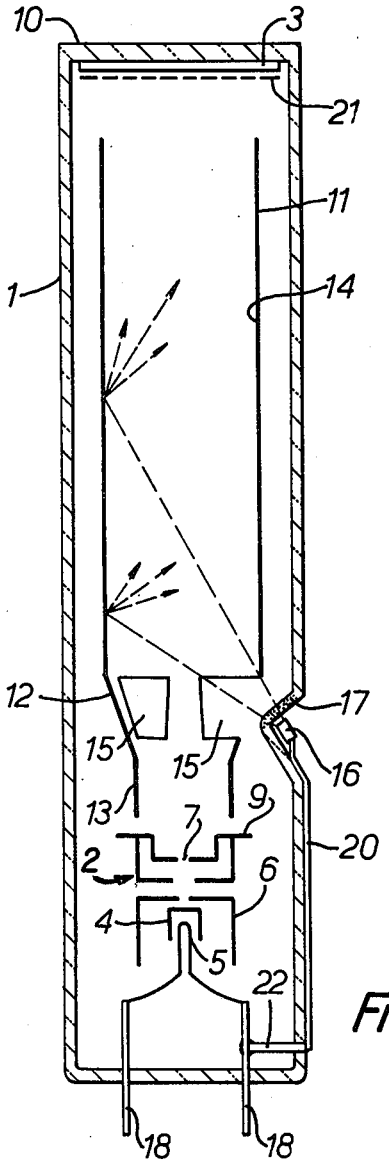

This invention relates to photosensitive tubes and more particularly to pick-up tubes of the photoconductive target type.

Photoconductive target pick-up tubes are now known in which the target is comprised of lead monoxide.

Compared with the conventional vidicon pick-up tube utilising a target composed of antimony tri-sulphide, the lead monoxide target pick-up tube exhibits increased resolution, a faster response and a lower dark current. In general these features are advantageous. However at low operating light levels the low dark current of the lead monoxide target camera tube tends to accentuate two undesirable effects. The first of these is build-up lag, that is to say a delay in the build-up of signal current following a change in tone from black to white, and the second of these is decay lag, that is to say a delay in the decay of signal current current following a change in tone from white to black.

Our earlier U.S. Pat. No. 3,892,994 sought to provide improved photosensitive tubes of the kind in which the target exhibits a natural relatively low dark current, and in particular improved lead monoxide pick-up tubes in which the tendency to suffer from build-up lag and decay is reduced. As is stated in this earlier patent, the above mentioned drawbacks can be dealt with by providing the target with a light bias which generates a low level ambient light condition resulting in a low but significant dark current as this has the effect of making any lag less objectionable. The arrangements described in the aforementioned patent are not entirely satisfactory, particularly for photosensitive tubes have physically very small targets and the present invention seeks to provide a more advantageous construction.

According to this invention, a photosensitive pick-up tube includes an evacuated tubular envelope having a photoconductive target at one end thereof; a tubular anode electrode positioned between an electron gas assembly and said target and having a portion at which its cross-section reduces situated along its length remote from said target; the evacuated tubular envelope being locally deformed inwardly towards the tubular anode electrode in the region of said portion so as to accommodate a plurality of light emissive devices which are spaced apart from each other around the external surface of the tubular envelope, but which are positioned so as to lie within its overall outline, the envelope being light transmissive in at least said region so as to allow light from said devices to illuminate said target.

Preferably said portion of the tubular anode electrode comprises a reducing tapered portion thereof, although alternatively an abrupt step could be provided.

Preferably again said portion is apertured to allow light from said light emissive devices to enter the interior space of said tubular anode electrode.

Preferably again the inner surface of said tubular anode electrode is roughened or otherwise arranged to have light scattering properties in order to achieve diffused illumination of the rear of said target.

Preferably means for diffusing the light is provided between the light emissive devices and said tubular anode electrode. This further helps to ensure that an even distribution of light illuminates the rear of said target.

Conveniently, the means for diffusing the light comprises locally frosted portions of the evacuated envelope. Normally the entire evacuated envelope is formed of transparent glass and in such a case the locally frosted region can readily be produced by roughening or etching the surface of the envelope at selected regions.

Figure 2:
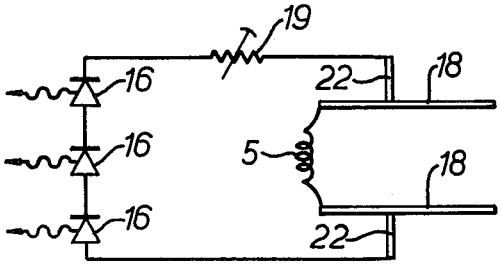

The invention is further described by way of example with reference to the accompany drawing, in which FIG. 1 shows a simplified sectional view of a lead monoxide pick-up tube in accordanc with the present invention, and FIG. 2 is an explanatory diagram.

Referring to FIG. 1, the pick-up tube consists of a transparent glass evacuated envelope 1 which is of a generally tubular shape and which has at one end an electron gun structure 2, which is arranged to produce an electron beam which is projected towards lead monoxide target 3 positioned at the other end of the envelope 1. The electron gun structure 2 comprises a cathode 4, which is indirectly heated by a heater coil 5, and which also includes electrodes 6 and 9. Conventionally electrode 6 is termed G1, and electrode 9 is termed G2 in known pick-up tubes. A small beam limiting aperture 7 is provided centrally in electrode 9. The target 3 is of a conventional nature and comprises a layer of lead monoxide deposited on a film of conductive tin oxide which is formed on the face plate 10 of the pick-up tube. An electrode 21, termed G4, is placed adjacent to the rear target 3 and a relatively long tubular anode electrode 11 is positioned between the electron gun structure 2 and the target 3-this is conventionally termed G3. Over most of its length this electrode 11 consists of a relatively large diameter cylinder, but as will be seen it has a reducing tapered portion 12, which joins another shorter cylindrical portion 13 of smaller cross-sectional diameter. The interior surface 14 of the tubular anode electrode 11 is roughened, for example, by means of a chemical etchant, and a ring of three apertures 15 (of which only two are visible in FIG. 1) is provided in the reducing tapered portion 12. These apertures 15 allow light to enter the interior of the electrode 11 from three light emitting diodes 16, which are equally spaced around the external surface of the transparent envelope 1, but which are recessed within local deformations of the envelope. These local deformations can conveniently be formed by distorting the glass envelope whilst it is heated to its softening temperature. Although in FIG. 1 three separate deformations are envisaged, it would alternatively be possible to produce a continuous circumferentially necked recess within which the diodes 16 would be mounted. Those portions 17 of the envelope 1 lying directly under the light emitting diodes 16 are frosted, and together with the roughened interior surface of the electrode 11 they ensure that the rear surface of the target 3 is illuminated by an even diffused light.

This diffused illumination produces a significant dark current which tends to reduce build-up lag and decay lag which can be experienced at low light levels of certain photosensitive pick-up tubes. In operation an optical image which is to be converted to a corresponding video signal by the pick-up tube is projected onto the front surface of the target 3 through the transparent face plate 10.

FIG. 2 shows the way in which the three light emitting diodes 16 are interconnected. They are connected in series across two external contact pins 18, which are normally provided so as to connect a d.c. voltage of about 6.3 volts to the heater 5 of the cathode 4. Voltage is applied across the two pins 18 so that the three diodes are forward biased and under these conditions they are light emissive. The colour of the light generated by the diodes is chosen so as to correspond with the most sensitive portion of the spectrum of the photoconductive target 10, as in this way the current flowing through the three diodes 16 can be minimised. It is desirable to adjust the effective intensity of the illumination of the interior surface of the target 3 during manufacture to produce the required level of dark current and this is achieved by the provision of an adjustable resistor 19, shown in diagrammatic form in FIG. 2.

The diodes 16 are connected to the pins 18 via external tracks 20 of electrically conductive paint or the like placed on the outer surface of the evacuated envelope 1. Thin electrically conductive Kovar pins 22 pass through the envelope 1 to make electrical contact with the pins 18 at a point within the evacuated region of the envelope. The pins 22 are hermetically sealed into the wall of the envelope. By making electrical connections in this way, the need is avoided to modify the conventional pin configuration normally associated with standard plug and socket arrangements of pick-up tubes in which light bias facilities are not provided. Conveniently, the electrically conductive tracks 20 can be formed of a slightly resistive material which then constitutes the current controlling resistor 19, and its effective resistance can be determined by trimming the width of the conductive track.

If desired, more than three light emitting diodes can be placed circumferentially around the tapered portion 12 at regular intervals, since this would enable the illumination of the rear surface of the target 3 to be achieved in a more even and uniform manner. Instead of light emitting diodes, very small incandescent filament bulbs could be used, but for the smaller sizes of photosensitive pick-up tube, the space available within the cylindrical envelope and the tapered portion 12 is extremely small and in practice it is more convenient to use miniature light emitting diodes. Typically the diameter of the target 3 is about only ¼ inch (20 mm.). It will be noted that the evacuated envelope 1 is locally deformed in the region of the tapered portion 12 to the extent necessary to allow the light emitting diodes 16 to be mounted so that they do not protrude beyond the otherwise smooth cylindrical outline of the tube. This is a very important consideration since it permits light bias tubes in accordance with this invention to be interchangeable with tubes which do not have this facility, without the need to modify the space available for occupation by the tube.

We claim:

1. A photosensitive pick-up tube comprising an evacuated tubular envelope having a photoconductive target at one end thereof and at least one reduced cross-sectional portion along the length thereof;

an electron gun assembly within said envelope for projecting an electron beam towards said target;

a tubular anode electrode within said envelope between said target and said gun assembly, said electrode having a reduced portion in the region of said reduced cross-sectional portion of said envelope; and a plurality of light emissive devices positioned outside said envelope and within said reduced cross-sectional portion of said envelope to direct light into said envelope for illuminating said target.

2. A tube as set forth in claim 1 wherein said portion of said electrode has a reducing tapered portion.

3. A tube as set forth in claim 1 wherein said portion of said electrode is apertured to allow light from each light emissive device to enter an interior space of said electrode.

4. A tube as set forth in claim 1 wherein said electrode has an inner surface with light scattering properties to achieve diffused illumination of a rear of said target.

5. A tube as set forth in claim 1 further comprising means between said light emissive devices and said electrode for diffusing light.

6. A tube as set forth in claim 5 wherein said means comprises frosted portions on said envelope.

7. A tube as set forth in claim 1 comprising a plurality of reduced cross-sectional portions in said envelope and a plurality of light emissive devices, each said device being disposed in a respective reduced portion.

8. A tube as set forth in claim 1 wherein said portion of said envelope is a circumferential recess and which further comprises a plurality of said devices located peripherally of said envelope within said recess.

9. A tube as set forth in claim 1 which further comprises a plurality of said devices connected electrically in series to receive a flow of current and means for determining the current flowing through said devices.

10. A tube as set forth in claim 9 wherein said means is a resistive track forming a part of an electrical supply path to said devices.

11. A tube as set forth in claim 10 wherein said electron gun assembly has a cathode heater connected in shunt with said devices.

12. A tube as set forth in claim 11 which further comprises a pair of first pins connected to said heater to supply power thereon and electrically conductive pins passing through said envelope in sealed manner to contact said first pins and to form a part of said electrical supply path.

* * * * *

UNITED STATES PATENT AND TRADEMARK OFFICE

CERTIFICATE OF CORRECTION

PATENT NO. : 4,465,927

DATED : August 14, 1984

INVENTOR(S) : Scholz

It is certified that error appears in the above-identified patent and that said Letters Patent is hereby corrected as shown below:

| Column | Line | From | To |
|---|---|---|---|
| 1 | 41 | "gas" | --gun-- |

Signed and Sealed this

*Twenty-sixth* Day of *February 1985*

[SEAL]

*Attest:*

DONALD J. QUIGG

*Attesting Officer*

*Acting Commissioner of Patents and Trademarks*